US005286110A

United States Patent [19]

Benson et al.

[11] Patent Number: 5,286,110

[45] Date of Patent: Feb. 15, 1994

[54] BAG HAVING TAMPER-RESISTANT SEAL

[76] Inventors: Mickey Benson, 115 W. B St., Port Hueneme, Calif. 93041; Donald P. Hilliard, 4610 Reading Dr., Oxnard, Calif. 93033

[21] Appl. No.: 41,206

[22] Filed: Apr. 1, 1993

[51] Int. Cl.[5] ..... B65D 33/34

[52] U.S. Cl. ..... 383/5; 24/30.5 P; 24/30.5 R; 206/497; 383/71

[58] Field of Search ..... 383/5, 71; 24/30.5 P, 24/30.5 W, 30.5 R; 206/497

[56] References Cited

U.S. PATENT DOCUMENTS 2,262,840 11/1941 Gibson et al. ..... 24/30.5 P
3,113,408 12/1963 Kirkpatrick et al. ..... 24/30.5 P
3,290,854 12/1966 MacMurray ..... 383/71
3,331,105 7/1967 Gordon ..... 206/497
3,720,750 3/1973 Countryman ..... 24/30.5 R

*Primary Examiner*—Stephen P. Garbe
*Attorney, Agent, or Firm*—Robert M. Sperry

[57] ABSTRACT

An improved tamper-resistant seal for use with generally U-shaped flexible closure devices, such as tabs and wire wraps, comprising an annular band dimensioned to encircle a flexible closure device and heat-shrinking the band to closely fit about the closure device to prevent removal of the closure device without prior destruction of the annular band.

5 Claims, 1 Drawing Sheet

BAG HAVING TAMPER-RESISTANT SEAL

BACKGROUND

1. Field of Invention

This invention relates to tamper-resistant seals and is particularly directed to means for providing tamper-proofing for sack-type packages which are sealed with flexible closure devices, such as wire wraps, flexible snap-on tabs and the like.

2. Prior Art

In recent years, there has been a significant increase in the number of cases which have involved food tampering. As a result, tamper-resistant seals are now required on many medical and food items and public concern over the matter has become significant. Also, it has become widely recognized that, even where food adulteration is not involved, unsealed packages are subject to pilferage and other undesirable events. However, there are still many food items which are not protected by tamper-resistant seals. Many of these food products, such as fruits, vegetables, loaves of bread, etc. are sold in plastic bags or sacks which are closed merely with a flexible closure device, such as a wire wrap, a plastic snap-on tab, or a similar device which provides virtually no protection for the articles contained in such bags. Unfortunately, little, if any, attention has been given to protecting these sack-type packages. Some prior art sealing devices have been proposed for protecting the closures of sack-type packages, but have been difficult for legitimate persons to remove. other prior art sealing devices have failed to provide adequate assurance against tampering. Still other prior art sealing devices have been complex and expensive to install and remove. A search in the U.S. Patent office has revealed the following:

| U.S. Pat. No. | INVENTOR | ISSUED |
|---|---|---|
| 2,465,349 | W. M. Brooks | Mar. 29, 1949 |
| 2,480,543 | W. M. Brooks | Aug. 30, 1949 |
| 2,992,034 | H. L. C. Wenk, Jr. | Jul. 11, 1961 |
| 4,898,412 | H. L. C. Wenk | Feb. 6, 1990 |

Each of these references is subject to the disadvantages discussed above. Thus, none of the prior art sealing devices for sack-type packages has been entirely satisfactory.

BRIEF SUMMARY AND OBJECTS OF INVENTION

These disadvantages of the prior art are overcome with the present invention and an improved sealing device is provided for use with sack-type packages having generally U-shaped shaped flexible closure devices, such as flexible tabs and wire wraps, which is inexpensive to produce and is simple to install and remove, yet provides positive protection against tampering and a clear indication as to whether or not tampering has occurred.

The advantages of the present invention are preferably attained by providing an annular band dimensioned to encircle a generally U-shaped flexible closure device, such as a flexible tab or wire wrap, and heat-shrinking the band to closely fit about the closure device to prevent removal of the closure device without prior destruction of the annular band.

Accordingly, it is an object of the present invention to provide an improved tamper-resistant seal.

Another object of the present invention is to provide an improved tamper-resistant seal for protecting sack-type packages.

An additional object of the present invention is to provide an improved tamper-resistant seal for flexible tab and wire wrap closure devices.

Another object of the present invention is to provide an improved tamper-resistant seal for use with flexible tab and wire wrap closure devices which is inexpensive to produce. A further object of the present invention is to provide an improved tamper-resistant seal for use with flexible tab and wire wrap closure devices which is simple to install and remove, yet provides positive protection against tampering.

Another object of the present invention is to provide an improved tamper-resistant seal for use with flexible tab and wire wrap closure devices which provides a clear indication as to whether or not tampering has occurred.

A specific object of the present invention is to provide an improved tamper-resistant seal for use with generally U-shaped flexible closure devices, such as tabs and wire wraps, comprising an annular band dimensioned to encircle a flexible closure device and heat-shrinking the band to closely fit about the closure device to prevent removal of the closure device without prior destruction of the annular band.

These and other objects and features of the present invention will be apparent from the following detailed description, taken with reference to the figures of the accompanying drawing.

DETAILED DESCRIPTION OF THE INVENTION

Figure 1:
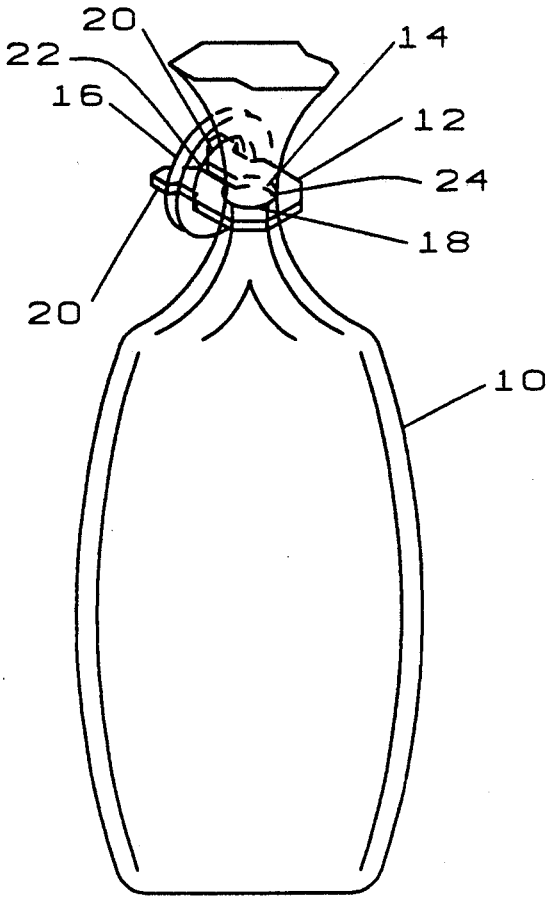
FIG. 1 is a diagrammatic representation showing a package secured with a flexible tab closure device having a tamper-resistant seal embodying the present invention.
Figure 2:
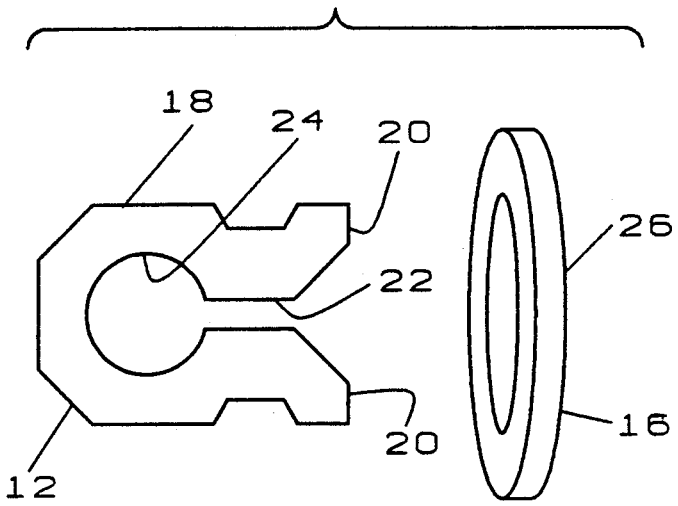
FIG. 2 is an exploded view of the closure device and tamper-resistant seal of FIG. 1.

In that form of the present invention chosen for purposes of illustration in the drawing, FIG. 1 shows a package, indicated generally at 10, having a flexible tab closure device 12 securing the neck 14 of the package 10 and protected against tampering by a tamper-resistant seal 16, embodying the present invention. As is well known, the flexible tan closure device 12 comprises a generally U-shaped member 18 formed of flexible material, such as plastic, having a pair of generally parallel legs 20 separated by a slit 22 which communicates with a central opening 24. To close the package 10, the neck 14 of the package 10 is twisted or otherwise gathered and is inserted, through slit 22, into the opening 24 of the closure device 12 and the resiliency of the legs 20 serves to retain the neck 14 of the package and, hence, to hold the package 10 closed. Normally, the closure device 12 can easily be removed by simply displacing the legs 20 in opposite directions to enlarge the slit 22 and, thus, to allow removal of the neck 14 of the package. Obviously, the flexible tab closure device 12 can quickly and easily be removed and reinstalled whenever desired by any one who chooses to do so. This makes the flexible tab closure device 12 simple and convenient for the user, but makes it equally convenient for someone wishing to tamper with or steal the contents. However, as seen in FIGS. 1 and 2, the present invention calls for the addition of tamper-resistant seal 16 which comprises an annular band 26, formed of heat-shrinkable plastic, which is dimensioned to slideably encircle the legs 20 of the flexible tab closure device 12 and which, after heat shrinking, fits closely about the legs 20 so as to prevent displacement of the legs 20. Consequently, the closure device 12 cannot be removed from the neck 14 of the package 10 without previously destroying and removing the tamper-resistant band 16. When someone desired to open the package 10, they simply break the tamper-resistant band 16 and, then, remove the flexible tab closure device 12 in the usual manner. The band 16 can readily be broken and removed. However, the necessity for doing this will deter or slow the actions of vandals and other wrongdoers. Moreover, the fact that the band 16 has been broken or removed will be immediately apparent to consumers. Thus, the presence of the band 16 provides assurance for the consumer that no tampering has occurred, yet the band 16 can quickly and easily be removed by the consumer, when desired.

Figure 3:
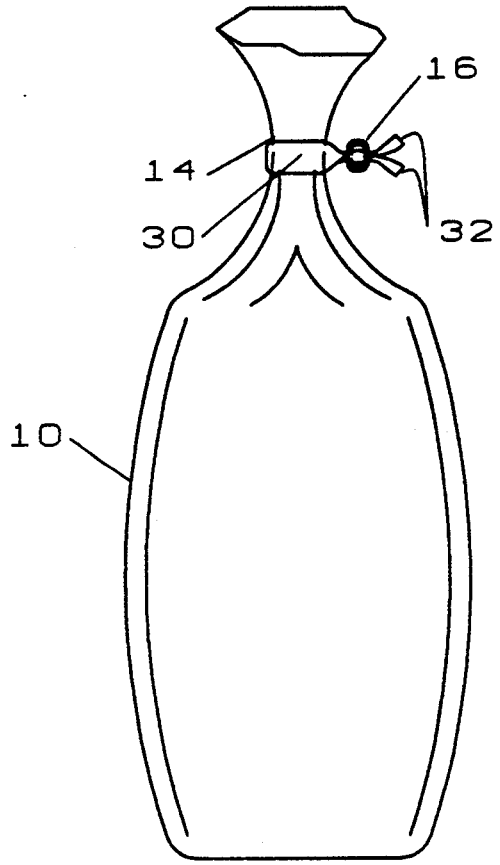
FIG. 3 is a view, similar to that of FIG. 1, showing the temper-resistant seal of the present invention protecting a wire wrap closure device.

FIG. 3 shows the tamper-resistant band 16 serving to protect a package 10 having the neck 14 closed by a wire wrap closure device 30 and protected by a tamper-resistant seal 16, similar to that of FIGS. 1 and 2. As is well known, the wire wrap closure device 30 comprises a length of flexible plastic or wire. To close the package 10 with the wire wrap closure device 30, the neck 14 of the package 10 is twisted or gathered and the wire wrap closure device 30 is looped into a generally U-shape about the neck 14 with two ends 32 extending generally parallel to each other. The two ends 32 of the wire wrap 30 are then twisted together to close and retain the neck 14 of the package 10. Normally, the wire wrap closure device 30 can quickly and easily be removed by simply untwisting the ends 32 of the wire wrap closure device 30. However, to provide protection against tampering, the annular band 16 is slipped over the twisted portion of the wire wrap closure device 30, as seen in FIG. 3, and is heat-shrunk to fit closely about the wire wrap closure device 30. With the band 16 applied, the wire wrap closure device 30 cannot be untwisted for removal, without destruction of the tamper-resistant seal 16. As noted above, the tamper-resistant seal 16 can be broken and removed quickly and easily, when desired. However, the necessity for doing this will deter or slow the actions of vandals and other wrongdoers and the fact that the band 16 has been broken or removed will be immediately apparent to consumers.

Obviously, numerous other variations and modifications can be made without departing from the spirit or the present invention. Therefore, it should be clearly understood that the forms of the present invention described above and shown in the figures of the accompanying drawing are illustrative only and are not intended to limit the scope of the present invention.

What is claimed is:

1. A tamper-resistant seal comprising:

a sack type package having a neck, a generally U-shaped flexible closure device encircling said neck to releasably close said package, and an annular band of heat-shrinkable plastic dimensioned to slideably encircle said closure device prior to heat-shrinking and being heat-shrunk to fit closely about the closure device so as to prevent removal of the closure device without prior removal of said band.

2. The seal of claim 1 wherein:

said closure device is formed of flexible material and has a pair of generally parallel legs, and said band is dimensioned to slideably fit about said legs prior to shrinking.

3. The seal of claim 1 wherein:

said closure device is a flexible generally U-shaped tab having a pair of generally parallel legs separated by a slit, and said band is dimensioned to slideably fit about said legs, prior to shrinking, and, after shrinking, to closely grip said legs.

4. The seal of claim 1 wherein:

said closure device is a wire wrap having a pair of generally parallel legs wrapped about said neck with portions of said legs twisted together to close said neck, and said band is dimensioned to slideably fit about said portions of said legs, prior to shrinking and, after shrinking, to closely grip said portions.

5. The seal of claim 1 wherein:

said flexible closure device is reusable after removal of said band to allow reclosure of said sack type package.

* * * * *